US006339994B1

(12) United States Patent
Kaplan et al.

(10) Patent No.: US 6,339,994 B1
(45) Date of Patent: Jan. 22, 2002

(54) RAILCAR WITH TRACKLESS SUPPORT FOR RADIAL END DOOR

(75) Inventors: Daniel Joseph Kaplan, Norcross; Ralph Hartman Schorr, Lawrenceville; Ronny Lamar Allison, Winder; Barney Russell Willoughby, Jr., Watkinsville, all of GA (US)

(73) Assignee: Thrall Car Manufacturing Company, Chicago Heights, IL (US)

( * ) Notice: Subject to any disclaimer, the term of this patent is extended or adjusted under 35 U.S.C. 154(b) by 0 days.

(21) Appl. No.: 09/632,490

(22) Filed: Aug. 4, 2000

(51) Int. Cl.[7] ..... B61D 17/00
(52) U.S. Cl. ..... 105/404; 105/410
(58) Field of Search ..... 105/355, 240, 105/280, 308.1, 406.2, 404, 410, 396, 238.1

(56) References Cited

U.S. PATENT DOCUMENTS 4,265,183 A * 5/1981 Peisner et al. ..... 105/410
4,936,227 A * 6/1990 Baker et al. ..... 105/378
5,601,033 A * 2/1997 Ehrlich et al. ..... 105/355
5,765,486 A * 6/1998 Black, Jr. et al. ..... 105/410
5,829,360 A * 11/1998 Rench et al. ..... 105/355

* cited by examiner

*Primary Examiner*—S. Joseph Morano
*Assistant Examiner*—Robert J. McCarry, Jr.
(74) *Attorney, Agent, or Firm*—Fitch, Even, Tabin & Flannery

(57) ABSTRACT

A radial end door that includes, in addition to the conventional inner and outer rollers for supporting the door, a door mounted support on the inner portion of the door, unsupported by the railcar body when the door is open, but supported by the railcar body when the door is closed. The door mounted support preferably comprises a roller that can be added as a retrofit or upgrade to the existing door, without altering the basic configuration, geometry or operational characteristics of the door, except to improve the performance of the door. The door mounted support preferably cooperates with a floor-mounted support comprising a wear bar having a ramp portion to raise the door mounted support and increase loading on the outer roller as the door is closed. The door mounted support preferably includes a compact housing which may be easily retrofitted on existing doors and may be removed for service or replacement, and which does not interfere with ramp clearances or other clearances during loading and unloading of motor vehicles.

16 Claims, 3 Drawing Sheets

RAILCAR WITH TRACKLESS SUPPORT FOR RADIAL END DOOR

BACKGROUND OF THE INVENTION

The invention relates to end doors for railway cars, in particularly to radial end doors of the type used in railcars for transportation of automotive vehicles.

A radial end door of the type to which the invention relates is shown and described in U.S. Pat. No. 5,765,486, the disclosure of which is incorporated herein by reference. As described therein, each of the end doors is supported by inner and outer rollers at the bottom of the door. The rollers travel on an arcuate track extending along the floor of the car and out along the outside of the side wall. The track is curved substantially uniformly about a predetermined radius. A pair of lock pins are provided for engagement with bores on upper and lower decks of the railcar. Each lock pin is associated with a first bore corresponding to the open position of the door, and a second bore corresponding to the closed position of the door. This type of locking arrangement is illustrated in, e.g., U.S. Pat. No. 5,829,360, the disclosure of which is incorporated herein by reference.

While the door described and shown in U.S. Pat. No. 5,765,486 is believed to provide significant advantages over doors that have been used in the past, there is still room for improvement. The door has an outer portion that extends generally upward above the arcuate track when the door is in closed position, and has a generally planar inner portion extending inward therefrom. When the door is slammed, or closed with excessive force, it is possible that the door may rotate or rock inward to some extent, such that the top of the inner edge of the door moves beyond its closed position, and the lock on the upper deck may not properly engage. The door may jam in this position, leading to considerable difficulty in subsequently opening the door. Furthermore, even when the door is closed with the locks properly engaged, the door may nevertheless be susceptible to rocking about the inner roller, with the outer roller lifting slightly off the track. The inner roller is positioned at the inner extremity of the arcuate outer portion of the door, and thus it cannot be moved any further inward while still sharing a track with the outer roller without changing the configuration of the door.

In addressing the above problems, any solution should avoid unduly increasing the force required to open the door. It is desirable that the required opening force not exceed about 40 lbs.

It is a general object of the invention to solve the above mentioned problems without adversely effecting the load carrying capacity of the car, i.e., without reducing longitudinal clearance near the end of the car, while maintaining the basic, successful, proven configuration and geometry of the door arrangement described in U.S. Pat. No. 5,765,486.

SUMMARY OF THE INVENTION

The invention comprises a radial end door that includes a door mounted nose support on the inner portion of the door. The door mounted nose support preferably is unsupported by the railcar body when the door is open, but supported by the railcar body when the door is closed. The support preferably can be added as a retrofit or upgrade to the existing door, without altering the basic configuration, geometry or operational characteristics of the door, except to improve the performance of the door by addressing the problems discussed above. The support may be installed after installation of the door on the railcar, with a shim inserted on the railcar floor to assist in determining the proper elevation of the support.

In addition to the door mounted support, there is preferably provided a floor mounted support that engages the door mounted support when the door is in closed position.

The door mounted support preferably comprises a roller assembly, and the floor mounted support preferably comprises a wear bar having a ramp portion. As the door is moved toward its fully closed position, the door mounted support engages the ramp portion and is lifted slightly to increase load on the outer roller, and to assist in smoothly stopping the door at its closed position, even when the door is slammed or otherwise subjected to excessive closing force.

The door-mounted roller preferably is trackless, i.e., unlike the other rollers on the door, it does not travel on a track, but rather only performs a supporting function when the door is in or near its closed position.

The door-mounted nose support preferably is economical, lightweight and easily installed, and capable of interfitting with existing radial doors to be welded thereto. To this end, the door-mounted nose support preferably is composed of only a small number of parts, e.g., a roller assembly, a roller shaft supporting the roller assembly, and a housing supporting the roller shaft. In one embodiment, the housing includes a mounting plate having first and second flanges which are angled to lie flat against surfaces of the radial door, and which are welded thereto, and a roller-supporting intermediate portion between the flanges, suitably angled relative to the flanges to support the roller obliquely relative to the inner portion to the door so that its axis is substantially perpendicular to its direction of travel as the door reaches its closed position. The preferred housing further includes a compact, removable roller assembly that avoids interference with loading ramp clearances and motor vehicle clearances.

The roller assembly is preferably attached to the mounting bracket by a plurality of fasteners, at least some of which are disposed between the roller and the mounting bracket. This enables the roller assembly to removably attached to the mounting bracket without requiring the roller assembly to be much wider than the roller itself. The roller assembly thus requires less lateral clearance than conventional roller assemblies having outwardly extending flanges or ears.

In the preferred roller assembly, the roller is positioned between a C-shaped or channel-shaped roller support and a flat cover plate welded thereto. The roller support is removably secured to the mounting plate by fasteners such as bolts, and the roller shaft is supported by the roller support and cover plate.

The improvement preferably prevents rocking of the door, increases stability of the door, and increases loading on the outer roller when the door is in closed position. The door has sufficient strength and durability to withstand a period of several years of commercial rail service in transporting automotive vehicles with minimal maintenance. The door mounted support may be removed and replaced when necessary without undue difficulty.

DETAILED DESCRIPTION OF PREFERRED EMBODIMENT

The invention is preferably embodied in a railcar for transporting automotive vehicles, and more particularly in improved radial end doors 10 for the railcar. Each of the end doors 10 has a generally arcuate outer portion 11 and a straight inner portion 13.

Figure 1:
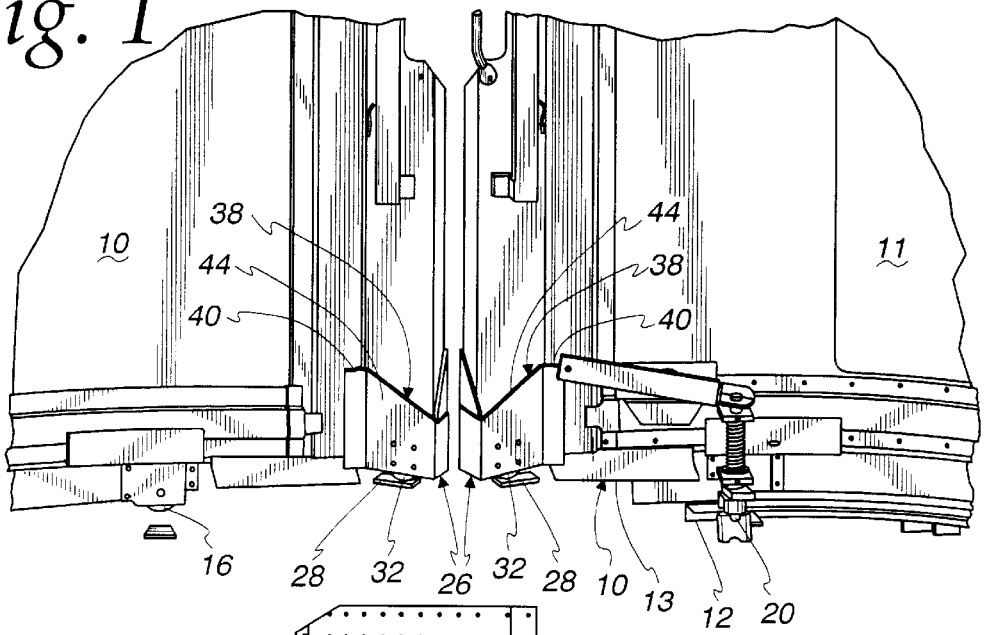
FIG. 1 is a view illustrating lower portions of a pair of end doors on a railcar in accordance with a preferred embodiment of the invention, with the end doors in closed position, taken from inside the railcar.
Figure 2:
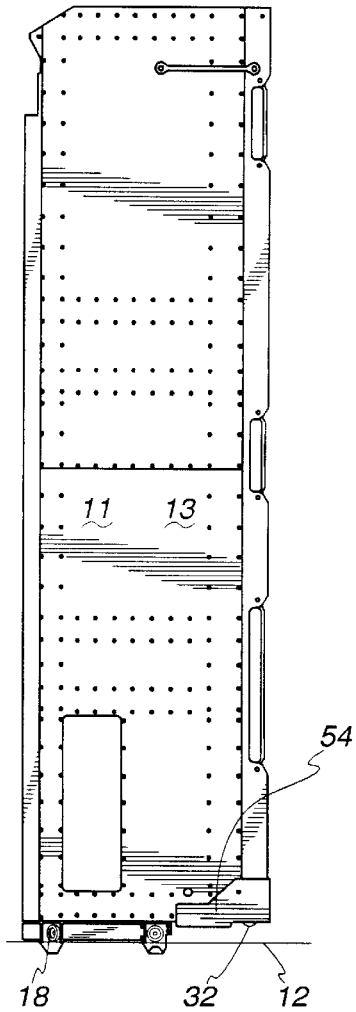
FIG. 2 is an elevation of the left hand end door, with portions omitted for clarity.
Figure 3:
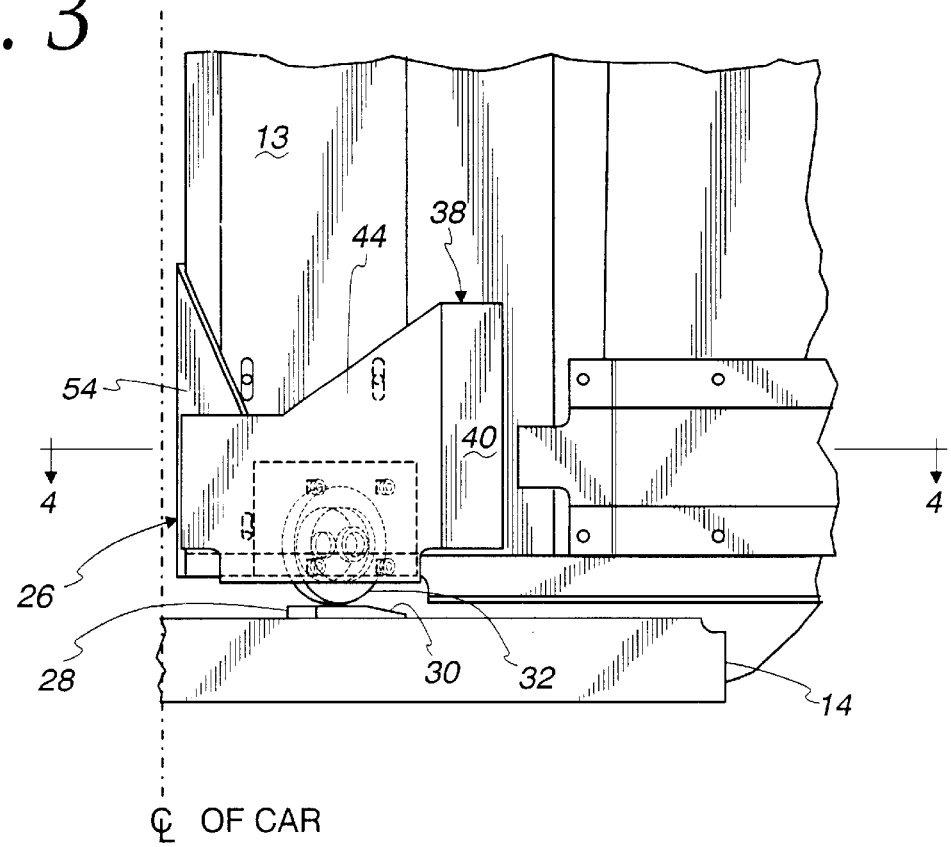
FIG. 3 is an elevational view of a door mounted nose support in a preferred embodiment of the invention.
Figure 4:
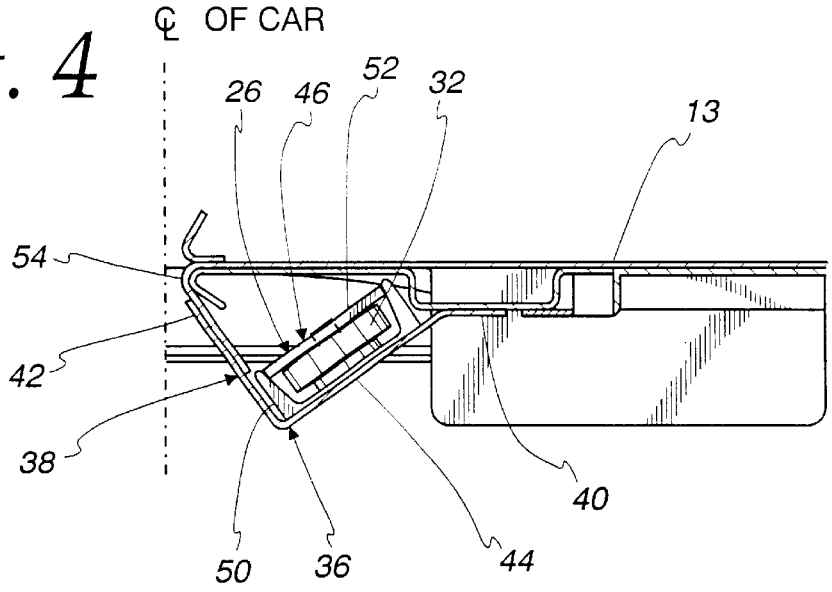
FIG. 4 is a sectional view taken substantially along line 4—4 in FIG. 3.
Figure 5:
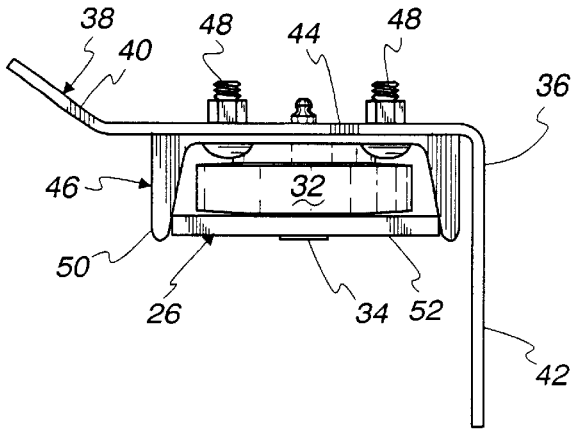
FIG. 5 is plan view of the door mounted nose support, shown separately from the door.
Figure 6:
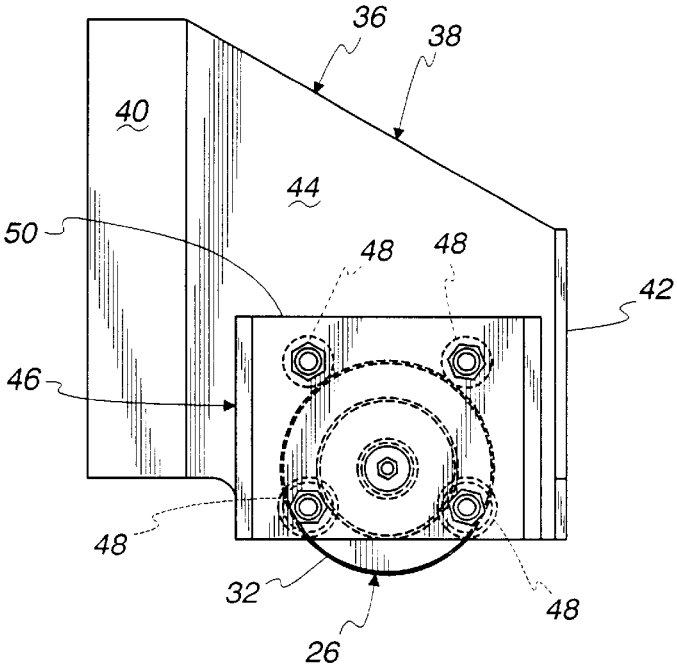
FIG. 6 is a front elevation thereof.
Figure 7:
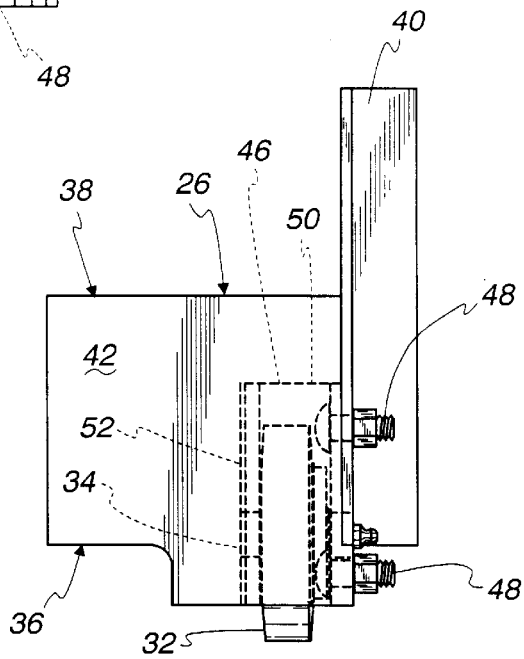
FIG. 7 is a side elevation thereof.

The end doors move between open and closed positions by traveling along arcuate tracks 12 extending along the floor of the car and out along the outside of the side walls. As shown in FIGS. 1 and 2, each of the end doors is supported by inner and outer rollers 16 and 18 at the bottom of the door. The rollers travel on the arcuate track. The track is curved substantially uniformly about a predetermined radius. A pair of lock pins 20 are provided for engagement with bores on upper and lower decks of the railcar. Each lock pin is associated with a first bore corresponding to the open position of the door, and a second bore corresponding to the closed position of the door, as described and shown in U.S. Pat. No. 5,829,360.

To solve problems relating to inward rocking of the upper portions of prior art radial end doors of this type, the preferred embodiment of the invention includes a door mounted nose support 26 on the inner portion of at least one of the radial doors. The door mounted support 26 is unsupported by the railcar body when the door is open, but supported by the railcar body when the door is closed. The support 26 preferably can be added as a retrofit or upgrade to an existing radial end door, without altering the basic configuration, geometry or operational characteristics of the door, except to improve the performance of the door by addressing the problems discussed above.

To ensure proper placement, the nose support 26 may be welded in place after installation of the door on the railcar, with a shim inserted on the railcar floor to position the support at the proper elevation on the door. To accomplish this, the nose support 26 is permitted to rest on the shim while the door is maintained in closed position with the inner and outer rollers on the track. The nose support is then tack welded or otherwise positioned on the door. The shim is removed after the nose support 26 is positioned on the door, and a permanent floor mounted support 28 is installed in its place with the door in open position. The floor mounted support engages the door mounted nose support 26 when the door is in closed position. The floor-mounted support preferably has a thickness greater than that of the shim so that the door-mounted nose support 26 and outer roller 18 are preloaded as the door is closed.

The floor mounted support preferably comprises a wear bar having a ramp portion. As the door is moved toward its fully closed position, the door mounted support engages the ramp portion and is lifted slightly to apply downward force to the outer roller, and to assist in smoothly stopping the door at its closed position, even when the door is slammed or otherwise subjected to excessive closing force.

In one embodiment the shim has a thickness of ⅛ in and the wear plate has a maximum thickness of ⅜ in. It is believed that use of these thicknesses will enable the nose support to perform its intended functions over a period of normal use of the railcar, notwithstanding strain and wear on the railcar components.

The door-mounted nose support 26 preferably is trackless, i.e., unlike the inner and outer rollers 16 and 18 on the door, it does not travel on a track, but rather only performs a supporting function when the door is in or near its closed position.

The door-mounted nose support 26 preferably is economical, lightweight and easily installed, and capable of retrofit installation on existing radial doors. The preferred door-mounted nose support 26 is composed of only a small number of parts, i.e., a roller assembly 46 and a housing 36 supporting the roller assembly 46 which may be installed on a door in conjunction with a housing support 54. The roller assembly 46 comprises a roller 32 mounted on a shaft 34. The housing 36 includes a mounting plate 38 having first and second flanges 40 and 42 which are angled to lie flat against surfaces of the housing support 54 and other components of the door radial door, and which are welded thereto, and an intermediate portion 44 between the flanges, suitably angled relative to the flanges to support the roller 32 obliquely relative to the inner portion 13 of the door so that the roller axis is substantially perpendicular to its direction of travel as the door reaches its closed position. The preferred roller assembly is compact and removable, and avoids interference with loading ramp clearances and motor vehicle clearances when the doors are open.

The roller 32 is of stepped configuration, having a first portion of large diameter and a second portion of smaller diameter. The roller assembly 46 is preferably attached to the mounting plate 38 by a plurality of fasteners 48 such as carriage bolts, at least some of which have their heads disposed between the large portion of the roller and the mounting plate. This enables the roller assembly to be removably attached to the mounting bracket without requiring the roller assembly to be much wider than the roller itself, and without requiring outwardly extending flanges or ears on the roller assembly.

The preferred roller assembly supports the roller for notation without requiring formed parts. To this end, in the preferred roller assembly, the roller is positioned between a C-shaped or channel-shaped roller support 50 and a flat cover plate 52 welded thereto. The roller support is removably secured to the mounting plate by the bolts 48, and the roller shaft 34 is supported by the roller support and cover plate. The roller support 50 and the cover plate 52 may be cut from readily available lengths of steel channel and flat bar products respectively, thus avoiding the need for custom forming of parts to support the roller for rotation and attachment to the mounting plate 38.

The improvement preferably prevents inward rocking of the door during closing and during subsequent operation of the railcar, increases stability of the door, and increases loading on the outer roller 18 when the door is in closed position. The door has sufficient strength and durability to withstand a period of several years of commercial rail service in transporting automotive vehicles with minimal maintenance. The door mounted support 26 may be removed and replaced when necessary without undue difficulty.

From the foregoing, it may be appreciated that the invention provides a novel and improved railway car for transport of automotive vehicles. The invention is not limited to the embodiments described above, and various modifications to the embodiments described above may be employed. For example, instead of using a roller in the door mounted nose support, a wear pad of Teflon or other suitable low friction material might be used. Alternatively, a floor-mounted roller might be used with a door-mounted wear pad. The invention is further shown and described in the accompanying drawings and in the following claims.

What is claimed:

1. In a railcar for commercial transportation of automotive vehicles, said railcar having a body including a floor, and a pair of end doors movable between open and closed positions, each of said end doors having an inner portion, an outer portion, and one or more rollers on the outer portion, the improvement comprising a door-mounted nose support on the inner portion of at least one of said doors, said door-mounted nose support being unsupported by said railcar body when said door is open, but supported by said railcar body when said door is closed.

2. The improvement of claim 1 further comprising a floor-mounted nose support, wherein said door-mounted nose support is engaged by said floor-mounted nose support when said door is in closed position.

3. The improvement of claim 2 wherein said door-mounted nose support comprises a trackless roller.

4. The improvement of claim 3 wherein said floor-mounted nose support comprises a wear bar having a ramp portion.

5. The improvement of claim 3 wherein said trackless roller is disposed obliquely relative to said inner portion of said door.

6. The improvement of claim 3 wherein said trackless roller assists in stopping the door at the closed position as it moves from open to closed position.

7. The improvement of claim 3 wherein said trackless roller cooperates with said one or more rollers on the outer portion to prevent rocking of said door, to increase stability of said door, and to increase loading on at least one of the rollers on the outer portion when the door is in closed position.

8. The improvement of claim 3 wherein said floor-mounted nose support and said door-mounted nose support have sufficient strength and durability to withstand a period of several years of commercial rail service transporting automotive vehicles.

9. The improvement of claim 1 wherein said door mounted nose support comprises a compact, removable roller assembly and a mounting bracket for removably attaching said roller assembly to said door, said door mounted nose support being capable of retrofit installation on existing radial end doors without interference with loading ramp clearances when the door is in open position.

10. The improvement of claim 1 wherein said roller assembly is attached to said mounting bracket by a plurality of fasteners, at least some of which have heads are disposed between the roller and the mounting bracket.

11. In a railcar having a floor, a pair of radial end doors movable between open and closed positions, and a pair of tracks on the floor, each of said radial end doors having an inner portion, an arcuate outer portion, and one or more rollers on the outer portion movable along said track, a method for preventing misalignment of one of said doors comprising:

providing a door mounted trackless nose support on the bottom of said one of said doors near its inner edge, and a floor mounted nose support on said floor; and positioning said one of said doors and said trackless nose support relative to said floor mounted nose support such that said door mounted trackless nose support contacts said floor mounted nose support only when said door is in or near its closed position.

12. The method of claim 11 wherein said floor mounted nose support is configured to increase upward force on said door mounted trackless nose support as said door approaches its closed position.

13. A method of controlling rocking of a railcar door, comprising:

placing the railcar door in closed position on the railcar with inner and outer rollers contacting a supporting track;

placing a shim on the railcar floor; and thereafter positioning a door mounted trackless nose support on the door with said nose support supported by said shim while said door is maintained in closed position with said inner and outer rollers contacting the supporting track.

14. The method of claim 13 further comprising, after positioning said nose support, removing said shim and attaching a wear plate to said floor, positioned so that said nose support will engage said wear plate when said door is closed.

15. The method of claim 14 wherein said wear plate has a ramp portion for initial engagement with said nose support as the door closes.

16. The method of claim 15 wherein said shim has a thickness less than the maximum thickness of said wear plate.

* * * * *